US007007810B2

(12) United States Patent
Huehner et al.

(10) Patent No.: US 7,007,810 B2
(45) **Date of Patent: *Mar. 7, 2006**

(54) SECURITY DEVICE FOR PREVENTING RAPID REMOVAL OF MERCHANDISE

(75) Inventors: David Huehner, Streetsboro, OH (US); Robert J. Michael, Coral Springs, FL (US); Michael Jaeb, Millersburg, OH (US); Dennis D. Belden, Jr., Canton, OH (US); Todd H. Christian, Wadsworth, OH (US); Nicholas M. Sedon, Massillon, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 86 days.

This patent is subject to a terminal disclaimer.

(21) Appl. No.: 10/692,099

(22) Filed: Oct. 23, 2003

(65) Prior Publication Data

US 2004/0084386 A1 May 6, 2004

Related U.S. Application Data

(63) Continuation of application No. 10/272,726, filed on Oct. 17, 2002, now Pat. No. 6,659,291, which is a continuation of application No. 09/705,435, filed on Nov. 3, 2000, now Pat. No. 6,474,478

(60) Provisional application No. 60/163,322, filed on Nov. 3, 1999.

(30) Foreign Application Priority Data

Nov. 3, 2000 (US) ..... PCT/US00/41893

(51) Int. Cl.
*E06B 73/00* (2006.01)

(52) U.S. Cl. ..... 211/57.1; 211/4; 211/59.1

(58) Field of Classification Search ..... 211/57.1, 211/54.1, 59.1, 4; 248/225.1

See application file for complete search history.

(56) References Cited

U.S. PATENT DOCUMENTS

| | | | | |
|---|---|---|---|---|
| 1,695,517 A | | 12/1928 | Waldbauer | |
| 2,441,407 A | | 5/1948 | Glavies | |
| 2,868,390 A | | 1/1959 | McCrone | |
| 3,048,311 A | | 8/1962 | Neuenfeldt | |
| 3,472,385 A | | 10/1969 | Shapiro et al. | |
| 3,567,034 A | | 3/1971 | Mozelsio | |
| 3,581,905 A | | 6/1971 | Shapiro | |
| 3,610,423 A | | 10/1971 | Parillo | |
| 3,622,011 A | | 11/1971 | Snow | |
| 3,659,721 A | | 5/1972 | Parillo | |
| 3,735,875 A | | 5/1973 | Parillo | |
| 3,827,569 A | * | 8/1974 | Canning | 211/7 |
| 3,934,727 A | | 1/1976 | Brefka | |
| 3,993,195 A | | 11/1976 | Caligiuri | |

(Continued)

FOREIGN PATENT DOCUMENTS

| | | |
|---|---|---|
| DE | 198 43 036 | 3/2000 |
| EP | 1199012 A1 | 4/2002 |
| FR | 2795294 A1 | 12/2000 |
| WO | WO 03/080972 A1 | 10/2003 |

*Primary Examiner*—Bruce A. Lev
(74) *Attorney, Agent, or Firm*—Sand & Sebolt

(57) ABSTRACT

A security device locks to a display structure such as a pegboard or slatboard to prevent the rapid removal of merchandise from the display structure by preventing the rapid removal of the entire security device. The security device includes a base and a rod with the base having locked and unlocked positions. The unlocked position of the base allows the security device to be removed from the display structure. The locked position of the base prevents the security device from being removed. The security device includes a lock that holds the base in the locked position. A key may be used to unlock the base. Customers may remove items of merchandise from the security device while the lock and base are in their locked positions.

17 Claims, 16 Drawing Sheets

U.S. PATENT DOCUMENTS 4,008,835 A 2/1977 Budzik
4,109,795 A 8/1978 Konigsford et al.
4,254,879 A 3/1981 Maule
4,289,242 A 9/1981 Kenyon
4,289,721 A 9/1981 Ishise
4,300,690 A 11/1981 Thomas
4,324,352 A 4/1982 Goldfarb et al.
4,363,430 A 12/1982 Radlin
4,474,300 A 10/1984 Entis
4,553,294 A 11/1985 Larsen
5,009,334 A * 4/1991 Bodkins ..... 211/54.1
5,011,054 A 4/1991 Mauffette
5,012,997 A 5/1991 Hutchison
5,018,627 A 5/1991 Moore
5,027,622 A 7/1991 Hatch et al.
5,042,669 A * 8/1991 Goldring ..... 211/4
5,082,215 A 1/1992 Hutchison
5,160,048 A 11/1992 Leyden et al.
5,251,757 A 10/1993 Relyea et al.
5,259,220 A 11/1993 Fredrickson
5,275,027 A 1/1994 Eklof et al.
5,348,167 A 9/1994 Jensen
5,423,436 A 6/1995 Morrow
5,485,930 A 1/1996 Rushing
5,542,633 A * 8/1996 Nagel ..... 248/214
5,597,150 A 1/1997 Stein et al.
5,624,040 A 4/1997 Hono
5,676,258 A 10/1997 Leyden et al.
5,689,978 A 11/1997 Eklof et al.
5,702,008 A 12/1997 Thalenfeld et al.
5,711,432 A 1/1998 Stein et al.
5,765,801 A 6/1998 Geiselman
5,823,358 A 10/1998 Leyden et al.
5,823,407 A 10/1998 Mayer et al.
6,003,685 A 12/1999 Malin
6,131,748 A * 10/2000 Kawasaki et al. ..... 211/54.1
6,223,915 B1 5/2001 Waner
6,279,256 B1 * 8/2001 Norolof et al. ..... 40/642.01
6,446,819 B1 * 9/2002 Mattesky ..... 211/57.1
6,474,478 B1 11/2002 Huehner et al.
6,659,291 B1 * 12/2003 Huehner et al. ..... 211/4
2001/0013567 A1 8/2001 Valiulis
2003/0029816 A1 2/2003 Huehner et al.
2004/0026344 A1 * 2/2004 Sedon et al. ..... 211/7

* cited by examiner

SECURITY DEVICE FOR PREVENTING RAPID REMOVAL OF MERCHANDISE

CROSS REFERENCE TO RELATED APPLICATIONS

This application is a continuation application of U.S. patent application Ser. No. 10/272,726 filed Oct. 17, 2002 U.S. Pat. No. 6,659,291, which claims priority from U.S. Pat. No. 6,474,478, which claims priority from U.S. provisional application Ser. No. 60/163,322 filed Nov. 3, 1999; the disclosures of each are incorporated by reference.

BACKGROUND OF THE INVENTION

1. Technical Field

The present invention generally relates to security devices and, more particularly, to a security device that prevents large numbers of items of merchandise from being rapidly removed from a display rack. Specifically, the present invention relates to a security device that holds merchandise on a display rack while only allowing one or two items of merchandise to be removed from the rack at any one time. The security device thus prevents a shoplifter from dumping a plurality of items of merchandise into a bag and making a quick escape.

2. Background Information

Numerous items of merchandise are displayed for sale on long protruding rods that are supported from a piece of pegboard or slatboard. These protruding rods are commonly referred to in the art as pegboard hooks or slatboard hooks. Such items of merchandise may be batteries, small tools, tool components, film, or other relatively expensive small items that are displayed in areas where consumers may pick them up. Unfortunately, such merchandise is an easy target for shoplifters. Merchandisers have found that shoplifters can rapidly empty all of the merchandise from a pegboard display hook and make off with the merchandise without being detected. It is desired in the art to provide a security device for these types of display racks so that large quantities of merchandise cannot be rapidly removed. Such a security device would allow legitimate consumers to remove merchandise one item at a time. Another problem in the art is that some shoplifters simply remove the entire pegboard hook including the merchandise from a display rack and steal the pegboard hook along with the merchandise.

BRIEF SUMMARY OF THE INVENTION

The invention provides a security device for a display board that prevents the rapid removal of multiple items of merchandise from the device. The invention slows a shoplifter by forcing the shoplifter to remove the items of merchandise one by one.

The security device may be locked to the display board so that the shoplifter cannot remove the entire device with the items of merchandise.

In one embodiment of the invention, the security device includes a locking end assembly that may be pivoted to an unlocked position so that the device may be easily loaded with merchandise.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 7:
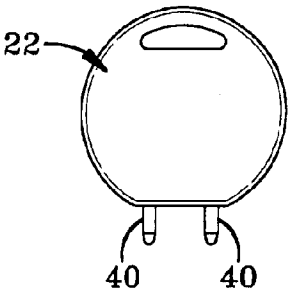
FIG. 7 is a front elevation view of the key for the first embodiment of the security device.
Figure 1:
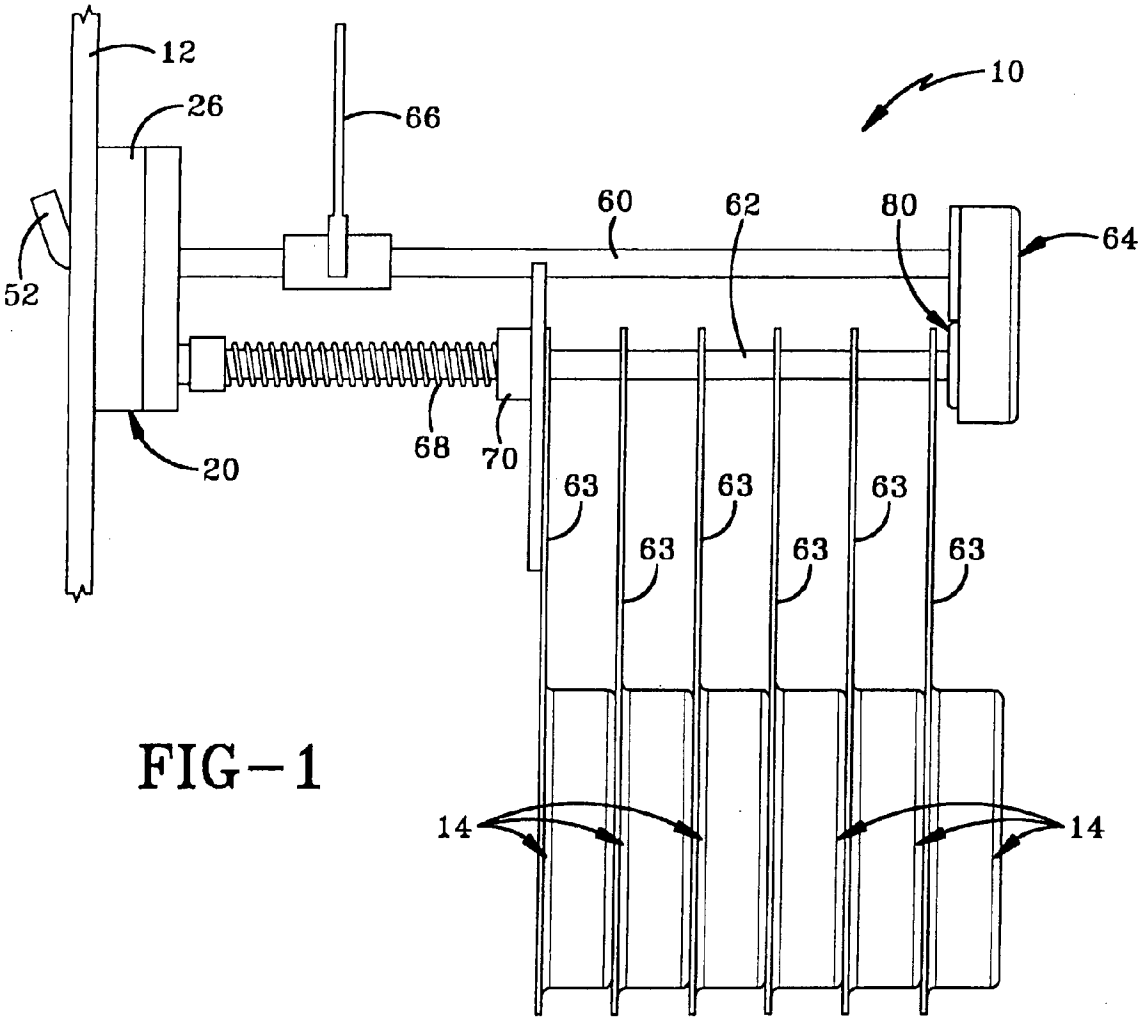
FIG. 1 is a side elevation view of the first embodiment of the security device of the present invention.

The security device of the present invention is indicated generally by the numeral 10 in the accompanying drawings. Security device 10 is used with a display board 12 (pegboard or slatboard) to support items 14 of merchandise for display in a retail environment. Device 10 holds multiple items of merchandise in a way that only allows one item 14 of merchandise to be removed from device 10 at a time thus preventing multiple items 14 from being removed all at one time.

Device 10 includes a locking base assembly 20 that selectively secures device 10 to board 12 in a manner that prevents device 10 from being removed from board 12 without the use of a specific key 22. Base assembly 20 includes an inner base 24 and an outer base 26. Outer base 26 slides over inner base 24 and locks inner base 24 in place against board 12. Inner base 24 has a main body 28 with a pair of opposed flanges 30 projecting out from either side of body 28. Outer base 26 includes a pair of slots that receive flanges 30 when outer base 26 is slid over inner base 24.

A lock 32 lockingly connects base 26 to base 24 when base 26 is slid all the way over base 24. Any of a variety of locks 32 will function with base assembly 20. In the preferred embodiment of the invention, a protruding lock member 34 extends outwardly from one flange 30 such that it catches and locks against a ledge 36 formed in outer base 26. A set of key holes 38 is disposed in outer base 26 in a position where they align with lock member 34 when base 26 is locked in position on inner base 24. Lock 32 is unlocked when the pins 40 of key 22 are pushed through openings 38 and depress lock member 34 down off of ledge 36. Once lock member 34 is depressed, outer base 26 may be slid off of inner base 24 so that inner base 24 may be removed from board 12.

Figure 2:
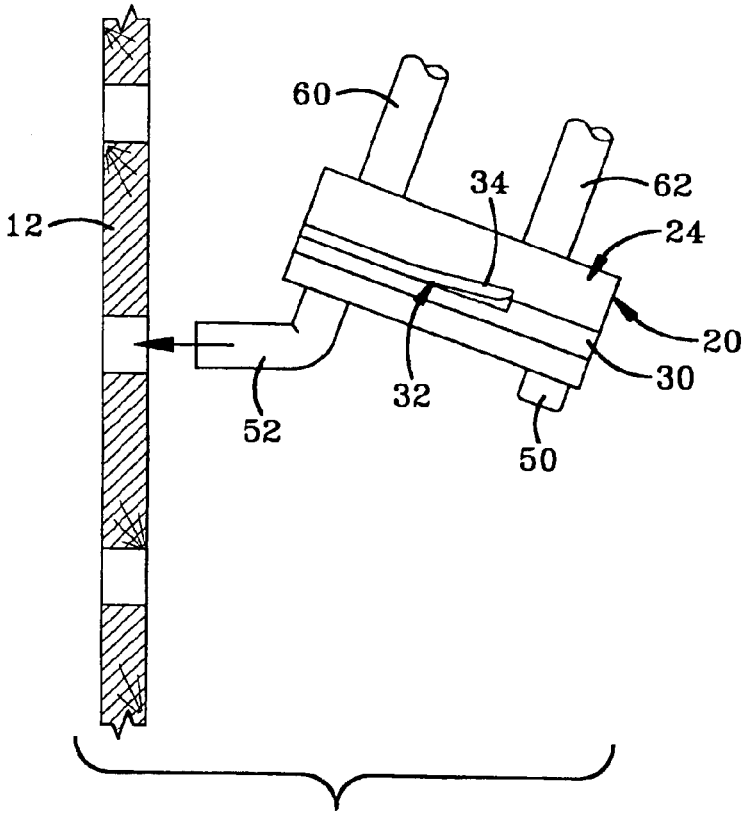
FIG. 2 is a side view, partially in section, of the first embodiment of the security device being installed in a pegboard.
Figure 3:
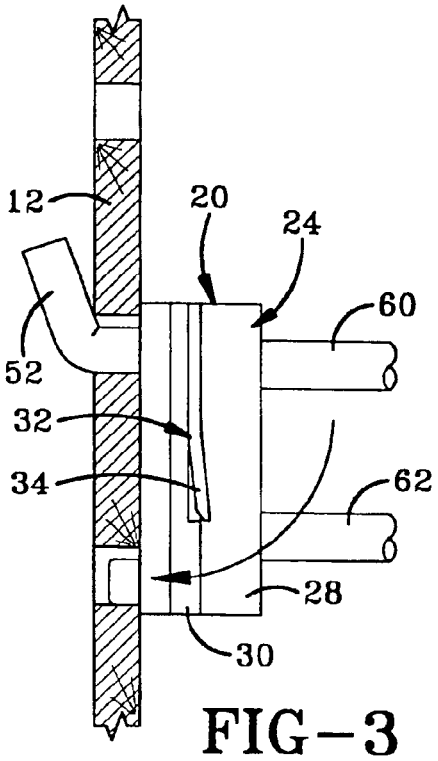
FIG. 3 is a side view similar to FIG. 2 showing the first embodiment of the security device installed in the pegboard in an unlocked condition.

Base assembly 20 may further include a pair of positional protrusions 50 and a pair of mounting hooks 52 that mount base assembly 20 to board 12. Protrusions 50 are optional but may be provided to position device 10 with respect to board 12. Hooks 52 are configured to fit into the holes of board 12 and be tilted upwardly as shown in FIGS. 2 and 3.

Figure 5:
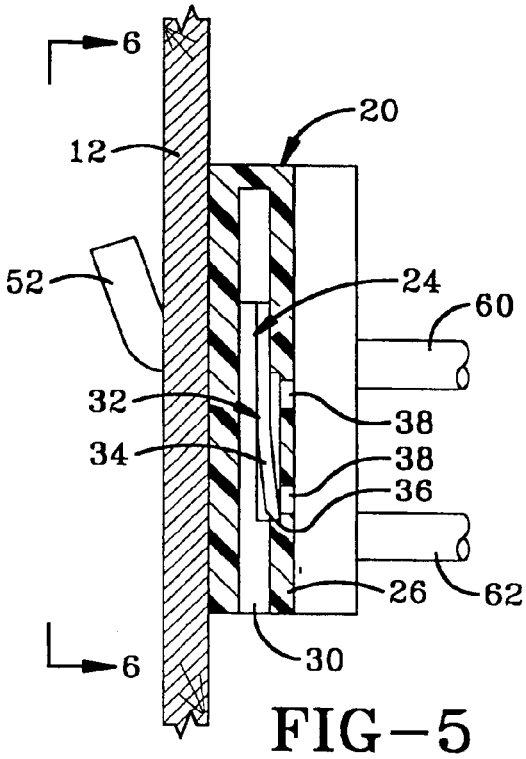
FIG. 5 is a sectional view taken along line 5—5 of FIG. 4.
Figure 4:
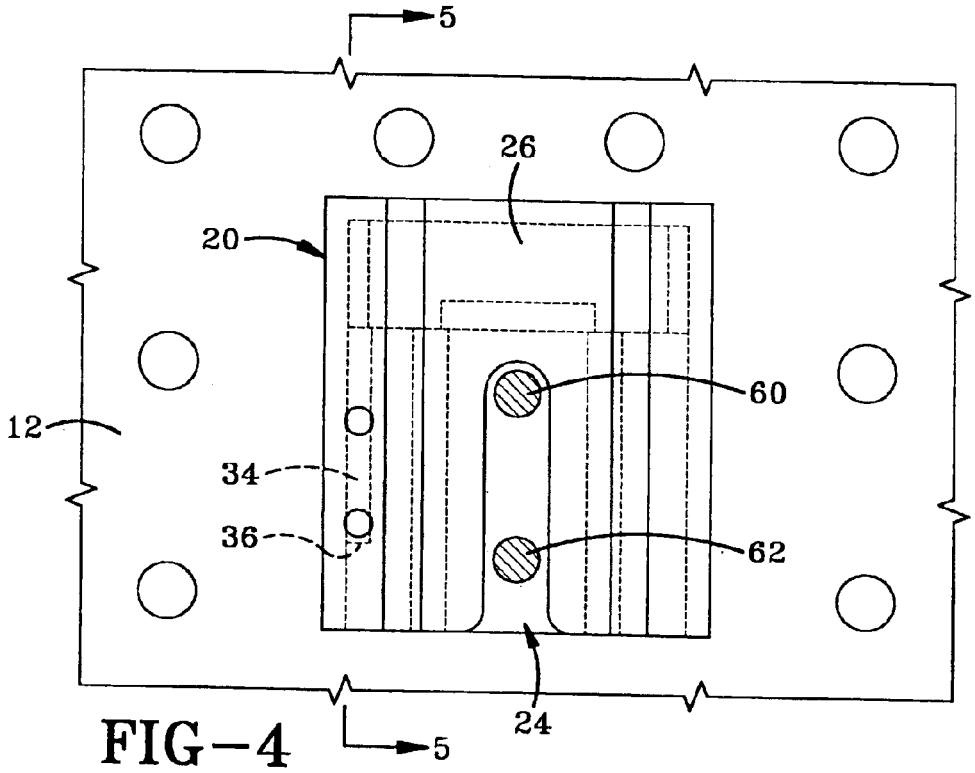
FIG. 4 is a front elevation view, partially in section, of the base of the first embodiment of the security device in a locked position.
Figure 6:
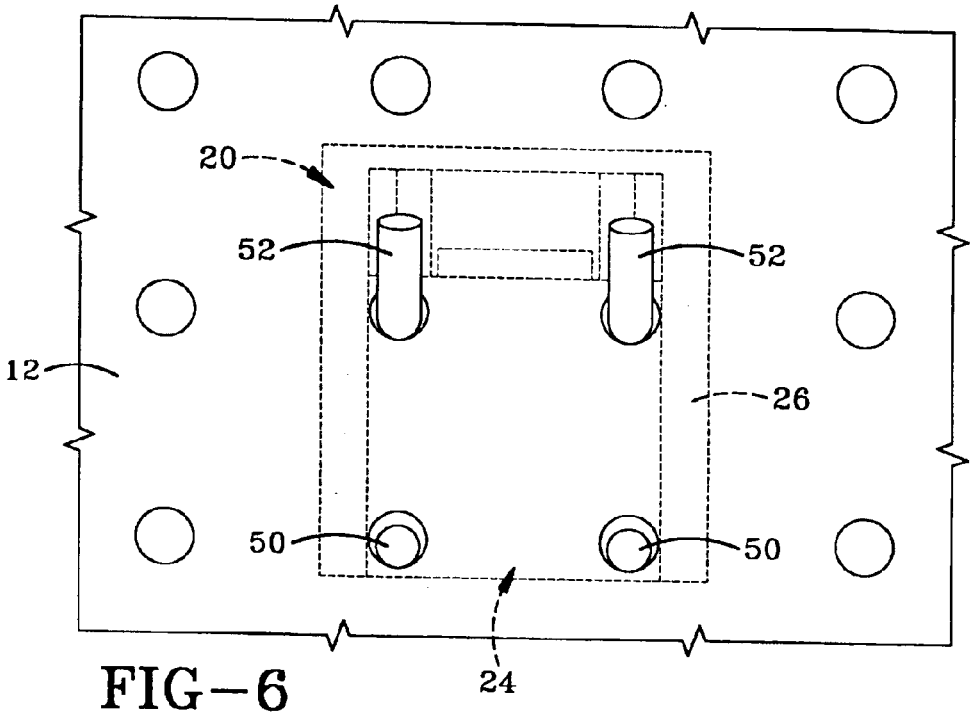
FIG. 6 is a rear elevation view of FIG. 4.

Base assembly 20 is thus installed by tilting inner base 24 upwardly so that hooks 52 may be fit into board 12. This position is depicted in FIG. 2. Inner base 24 is then tilted downwardly until inner base 24 rests against board 12. Outer base 26 is then slid over inner base 24 until it locks in place. Outer base 26 prevents inner base 24 from being removed from board 12 by wedging itself between board 12 and flanges 30 of inner base 24 and preventing it from tilting with respect to board 12. This position is depicted in FIGS. 4–6 and more specifically shown in FIG. 5.

A pair of rods 60 and 62 are anchored in inner base 24 and are cantilevered therefrom. Upper rod 60 supports an end assembly 64 away from base assembly 20. A price tag or product identification label 66 may be supported on rod 60 in a manner allowing it to be easily removed and replaced. For instance, label 66 may be clipped to rod 60 and may be slid back and forth on rod 60 so that it may be easily positioned anywhere along rod 60.

Lower rod 62 supports items 14 for display. Each item 14 includes a flange 63 having a hole that allows flange 63 to be received on rod 62. A spring 68 may be positioned adjacent rod 62 to constantly force flanges 63 and items 14 toward end assembly 64. A plunger 70 may be attached to spring 68 to prevent spring 68 from becoming entangled with items 14.

The outer end of rod 62 is disposed adjacent an end cup 80 that functions to cover the end of rod 62 to prevent multiple items 14 from being removed from rod 62 at one time. End cup 80 thus prevents a shoplifter from grasping all items 14 and simply pulling them off rod 62 in one quick movement. End cup 80 cooperates with rod 62 to only allow one, two, or possibly three items, to be pulled off of rod 62 at any one time. End cup 80 performs this function by being positioned closely adjacent the end of rod 62 such that there is only a small space through which flange 63 may be removed.

In the preferred embodiment of the invention, end cup 80 is slidingly and resiliently disposed in end assembly 64. End cup 80 is mounted in a cavity 82 formed in end assembly 64 such that end cup 80 frictionally slides along the inner wall of cavity 82. A spring 84 is connected to end cup 80 and to end assembly 64 preventing end cup 80 from falling out of end assembly 64. Spring 84 resiliently mounts end cup 80 so that it is always pushing or urged against the end of rod 62. Spring 84 also allows end cup 80 to be moved away from rod 62 to allow flanges 63 to pass between the end of rod 62 and end cup 80. In another embodiment of the invention, end cup 80 may include a magnet that is attracted to rod 62 and snaps against the end of rod 62 when flange 63 is not disposed between rod 62 and end cup 80. In still other embodiments of the invention, spring 84 may be replaced by a leaf spring instead of the coil spring depicted in the drawings. The end of rod 62 may have a rounded end, as shown in the drawings, to facilitate the removal of flanges 63.

Figure 12:
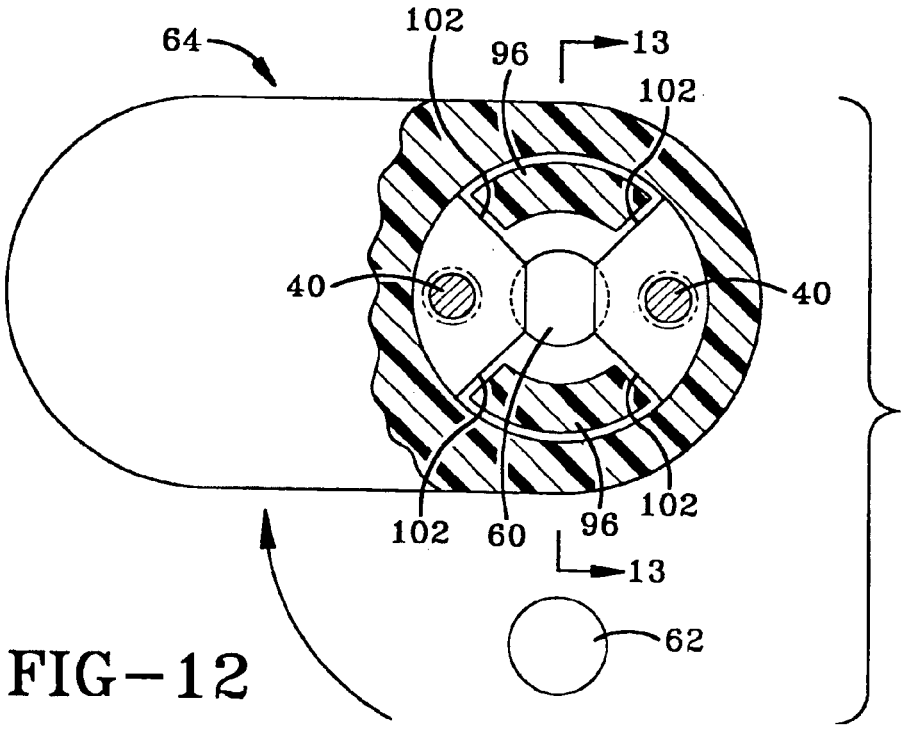
FIG. 12 is a view similar to FIG. 8 with the end cup in an unlocked position.

Although the device described above achieves the primary objectives of the present invention, loading device 10 is time consuming because a clerk must place each item 14 onto rod 62 one by one. It is thus desired to provide end assembly 64 with the capability of being rotated out away from rod 62 as depicted in FIG. 12 so that it may be readily loaded with items 14. Of course, the rotation must be selective in order to prevent a shoplifter from simply rotating end assembly 64 to the position depicted in FIG. 12 and removing items 14. As such, a lock assembly 90 is provided in end assembly 64 to allow rotation of end assembly 64 only upon the use of a specific key. In the preferred embodiment of the invention, the specific key is the same key 22 having the same pin 40 configuration that is used to unlock lock 32 of base assembly 20. This configuration allows a clerk to use a single key 22 to operate both locks 90 and 32.

Any of a variety of lock mechanisms may be used with end assembly 64 to provide these functions. Both mechanical and magnetically actuated lock mechanisms may be used. The mechanically actuated lock mechanism depicted in the drawings is provided as an exemplary embodiment for lock mechanism 90. It is understood that various other types of lock mechanisms may be used to lock end assembly 64 in place with respect to rod 62.

Figure 8:
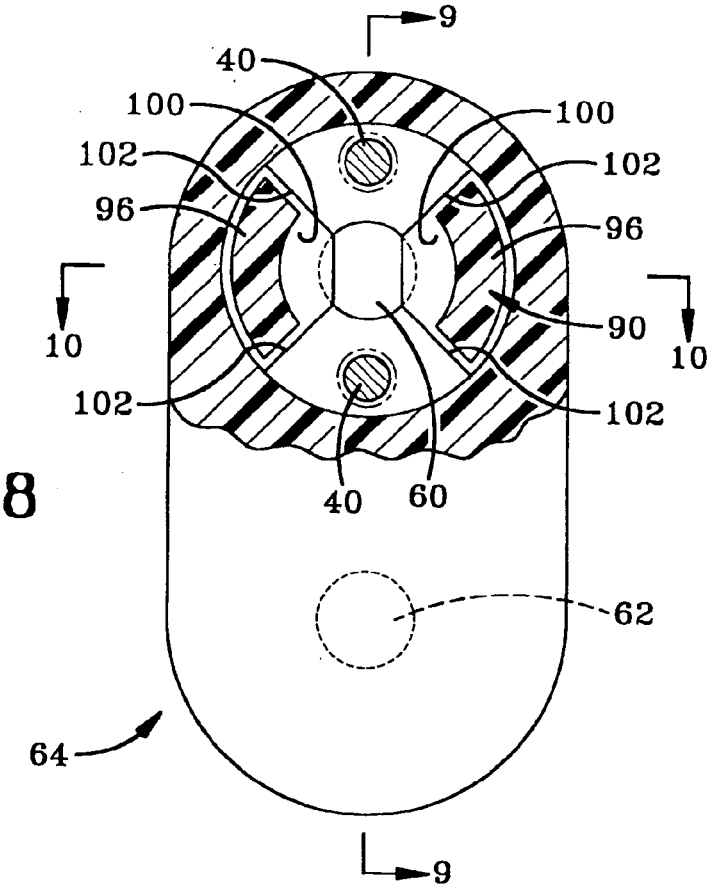
FIG. 8 is a front elevation view of the end cup of the first embodiment of the security device with the top portion in section showing elements of the lock.
Figure 9:
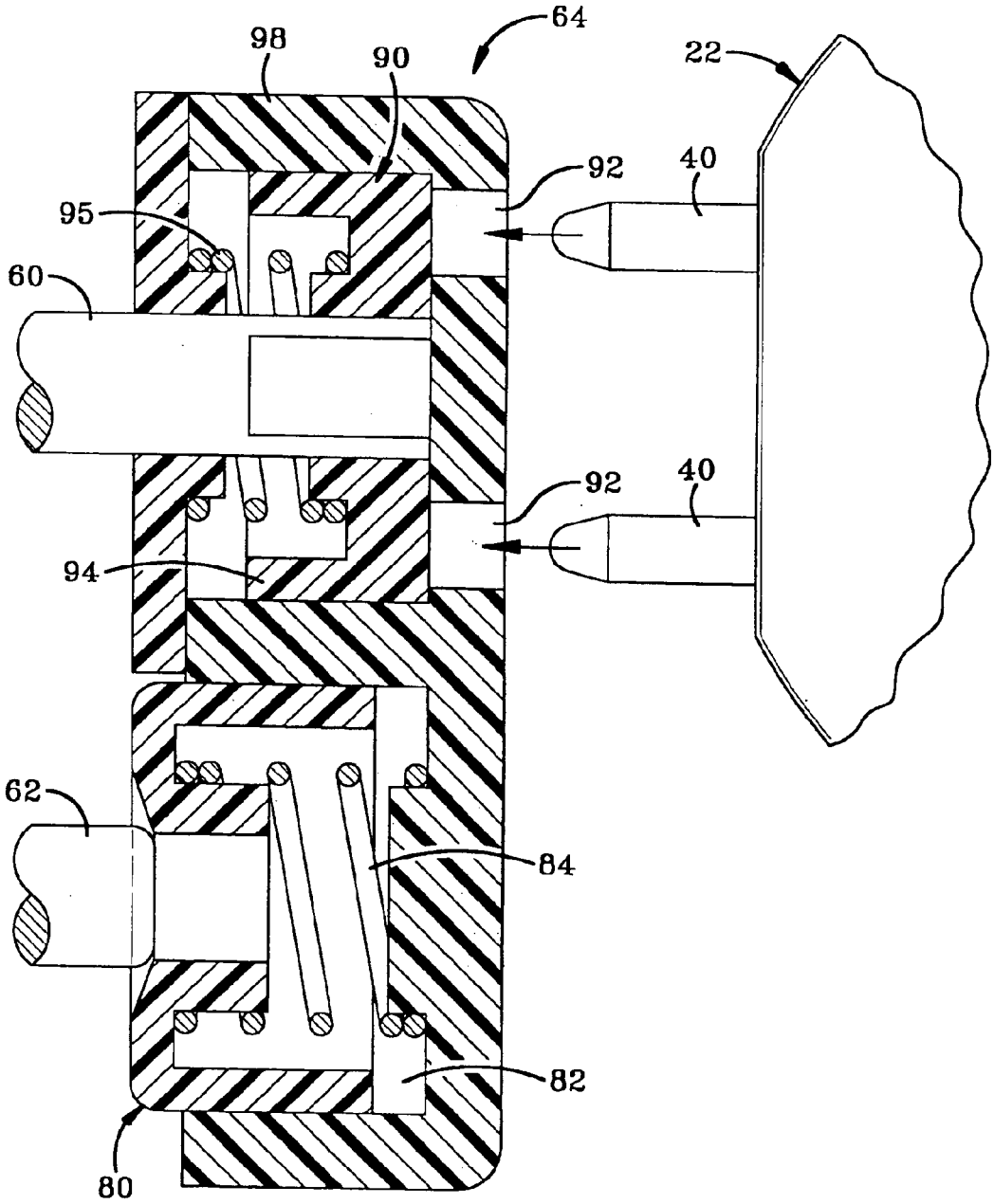
FIG. 9 is a sectional view taken along 9—9 of FIG. 8.
Figure 10:
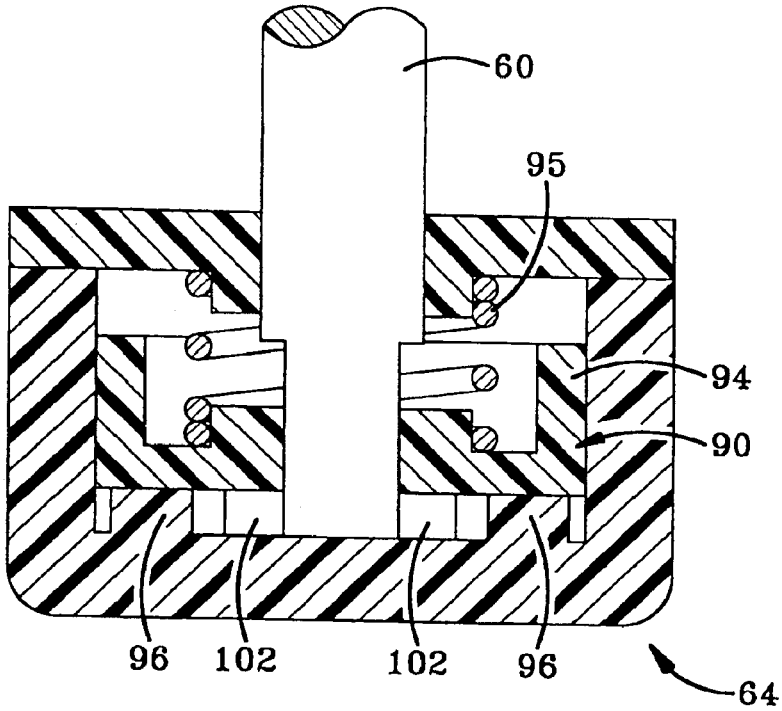
FIG. 10 is a sectional view taken along 10—10 of FIG. 8.

End assembly 64 includes a pair of key openings 92 that receive pins 40 of key 22. Openings 92 are aligned with a biased lock element 94 that selectively locks the position of end assembly 64 with respect to rod 60. Lock element 94 is biased toward openings 92 by a spring 95. End assembly 64 includes a pair of opposed protrusions 96 disposed intermediate openings 92, as shown in FIGS. 8 and 12. Protrusions 96 are disposed in an interfering relationship with lock element 94 such that the outer body 98 of end assembly 64 may not rotate with respect to lock element 94 when lock element 94 is in the locked position, as depicted in FIGS. 8 and 9. In this position, lock element 94 includes a pair of depressions 100 that receive protrusions 96. When body 98 is attempted to be rotated about rod 60, protrusions 96 engage the side wall 102 of depressions 100 and prevent further rotation.

Figure 13:
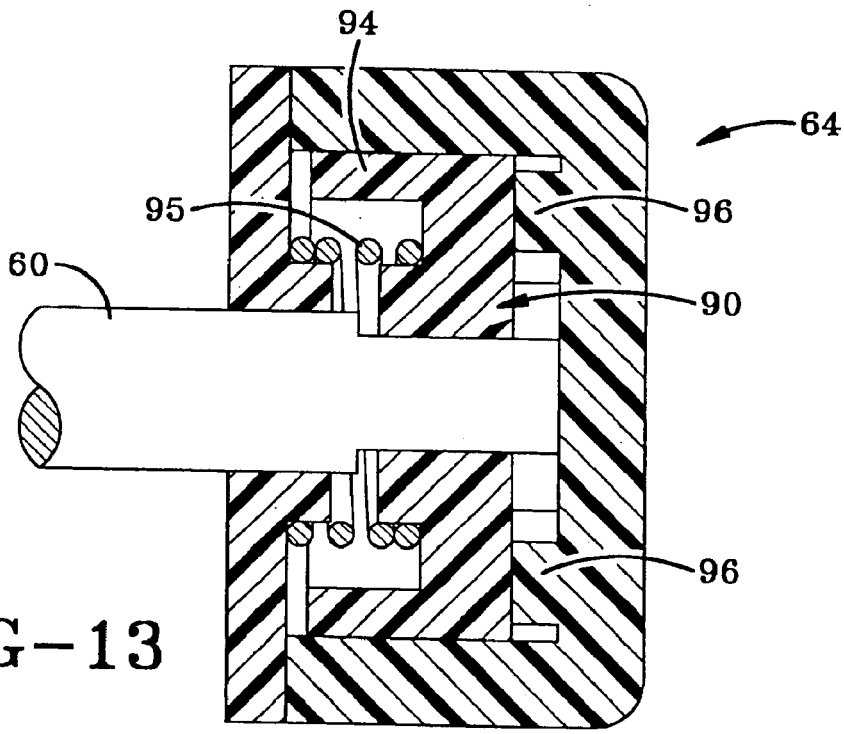
FIG. 13 is a sectional view taken along line 13—13 of FIG. 12.
Figure 11:
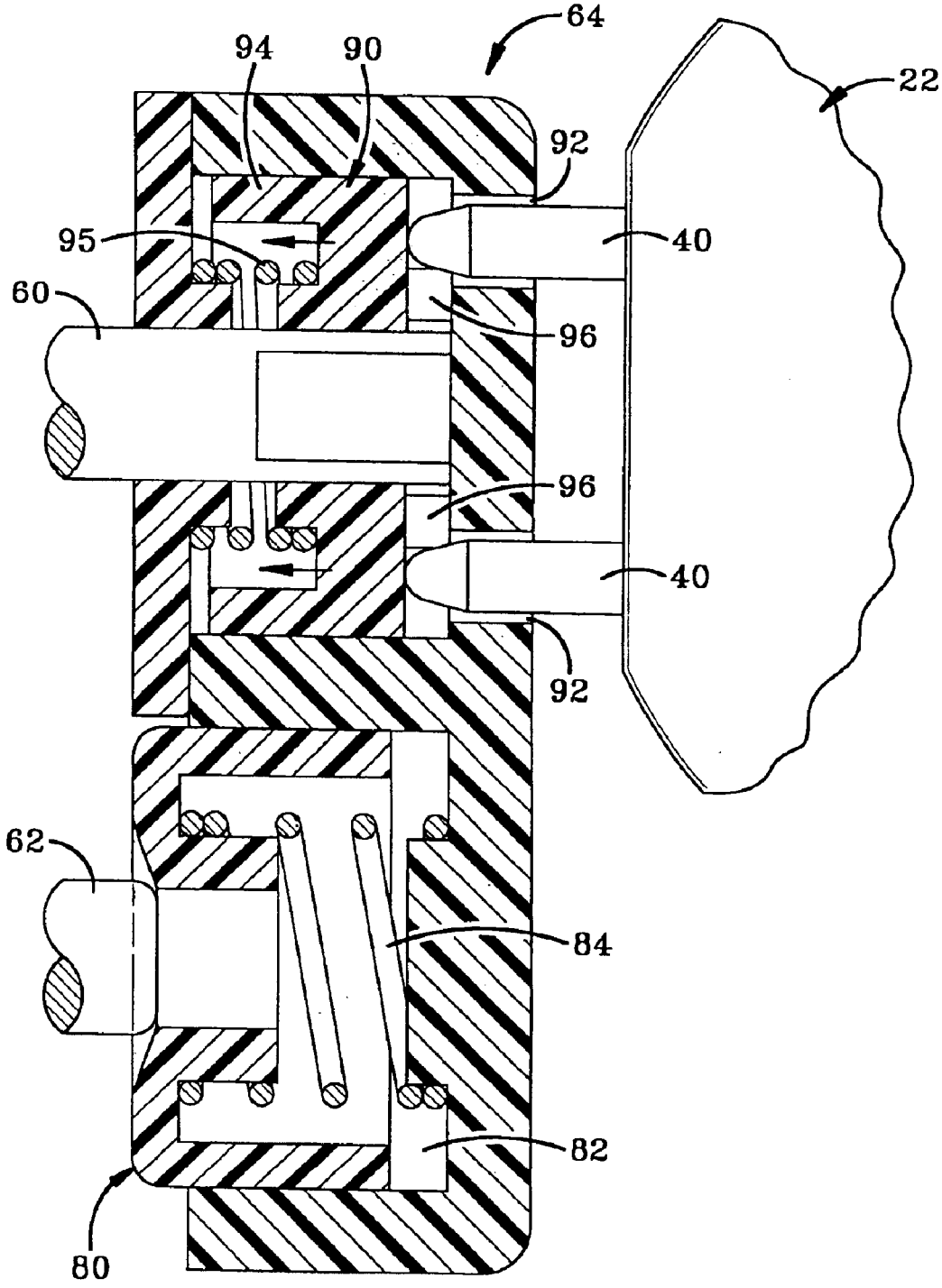
FIG. 11 is a longitudinal sectional view of the end cup with the key moving the lock to an unlocked position.
Figure 15:
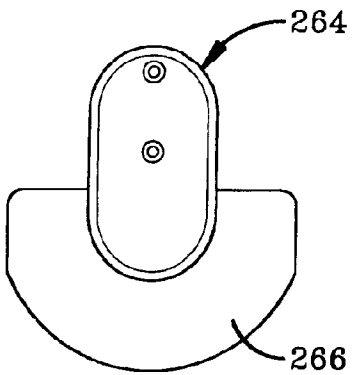
FIG. 15 is a front view taken along line 15—15 of FIG. 14.
Figure 14:
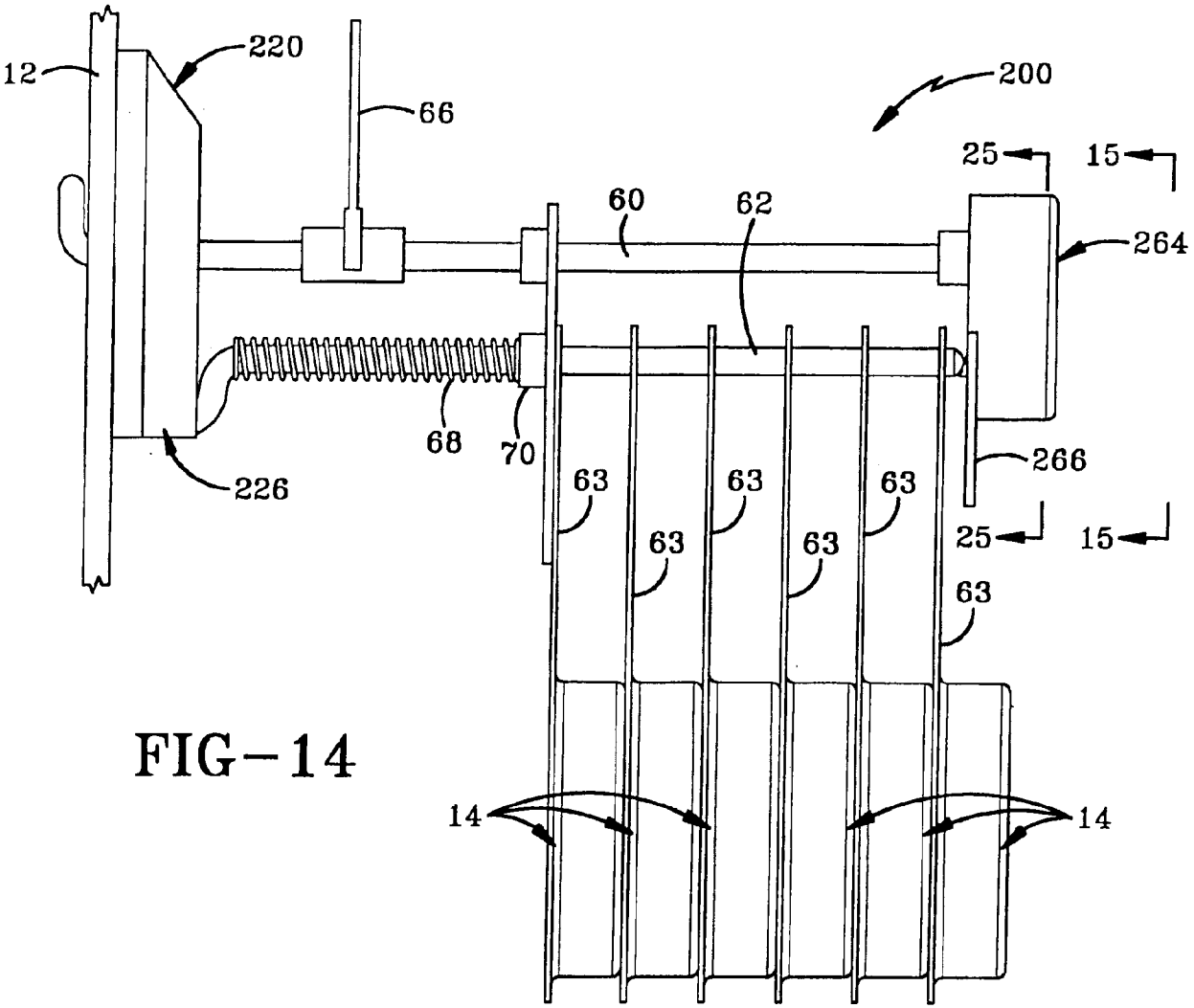
FIG. 14 is a side elevation view of the second embodiment of the security device of the present invention.
Figure 16:
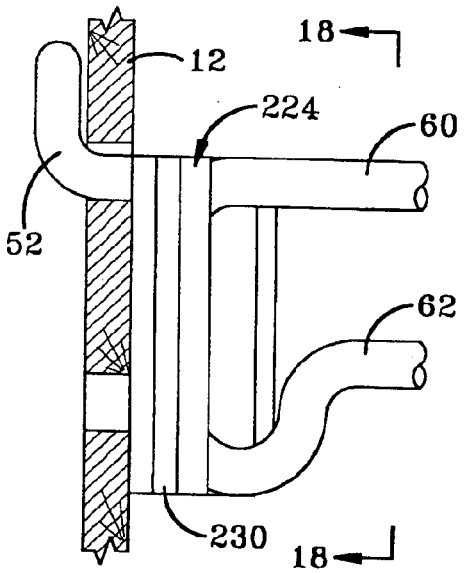
FIG. 16 is a side view, partially in section, of the inner base connected to the display board.
Figure 17:
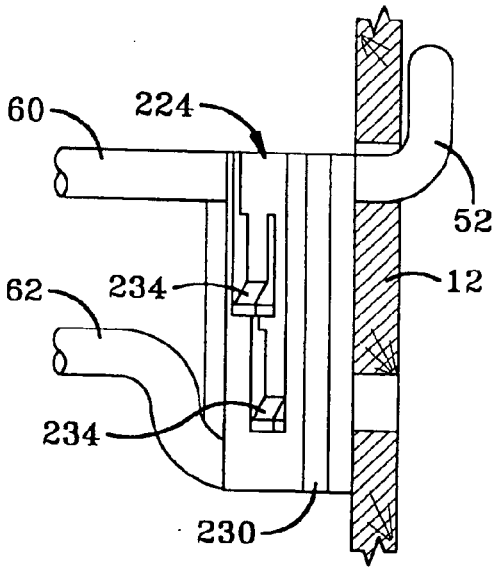
FIG. 17 is a side view, partially in section, of the inner base connected to the display board taken from the opposite side as FIG. 16.
Figure 18:
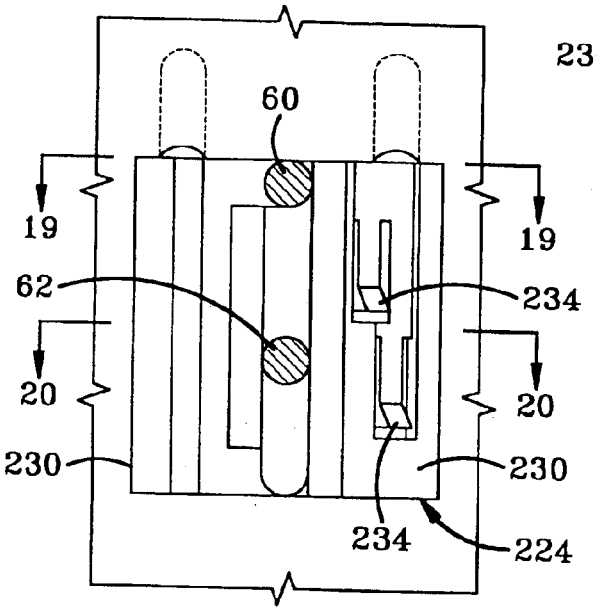
FIG. 18 is a section view taken along line 18—18 of FIG. 16.
Figure 19:
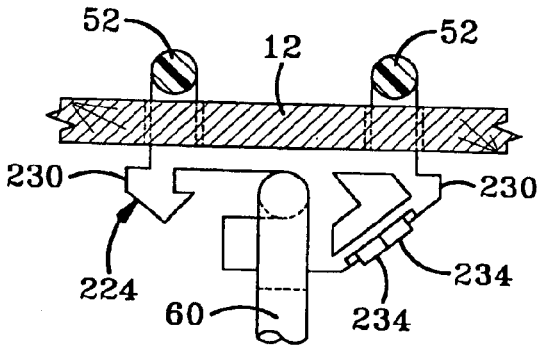
FIG. 19 is a section view taken along line 19—19 of FIG. 18.
Figure 20:
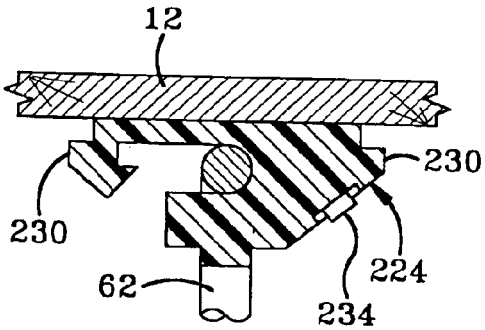
FIG. 20 is a section view taken along line 20—20 of FIG. 18.
Figure 21:
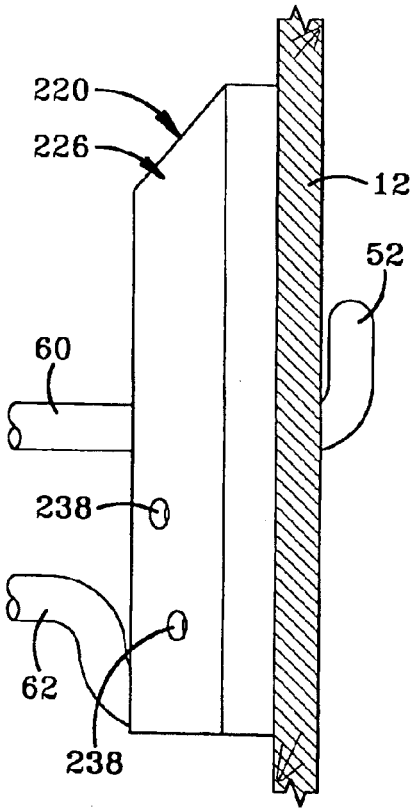
FIG. 21 is a side view of the outer base connected to the inner base.
Figure 22:
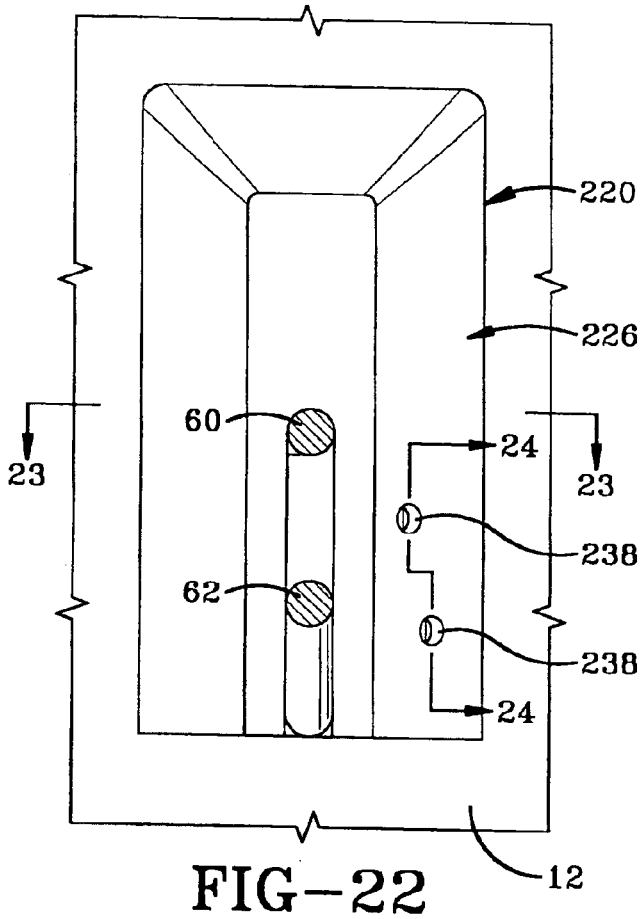
FIG. 22 is a view similar to FIG. 18 showing the outer base.
Figure 23:
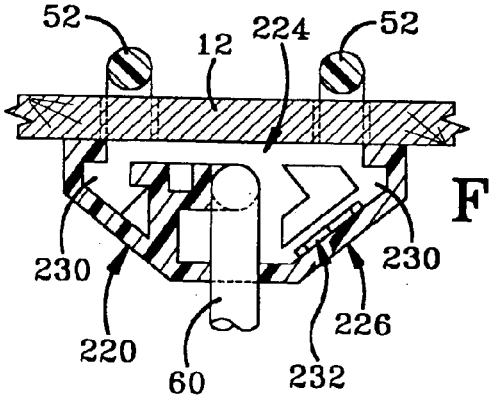
FIG. 23 is a section view taken along line 23—23 of FIG. 22.
Figure 24:
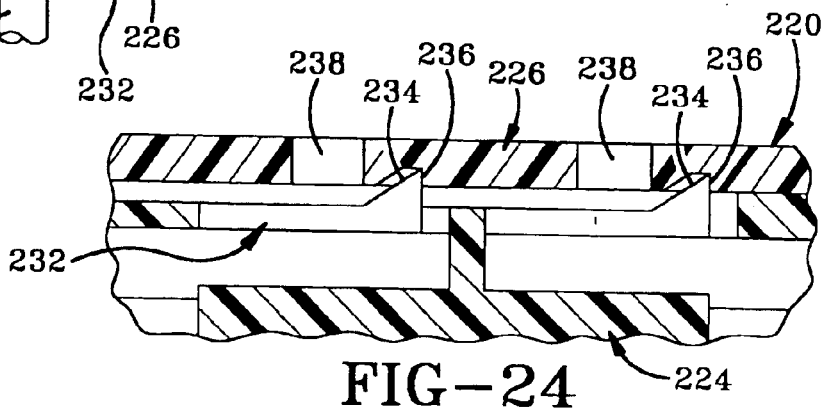
FIG. 24 is a section view taken along line 24—24 of FIG. 22.
Figure 25:
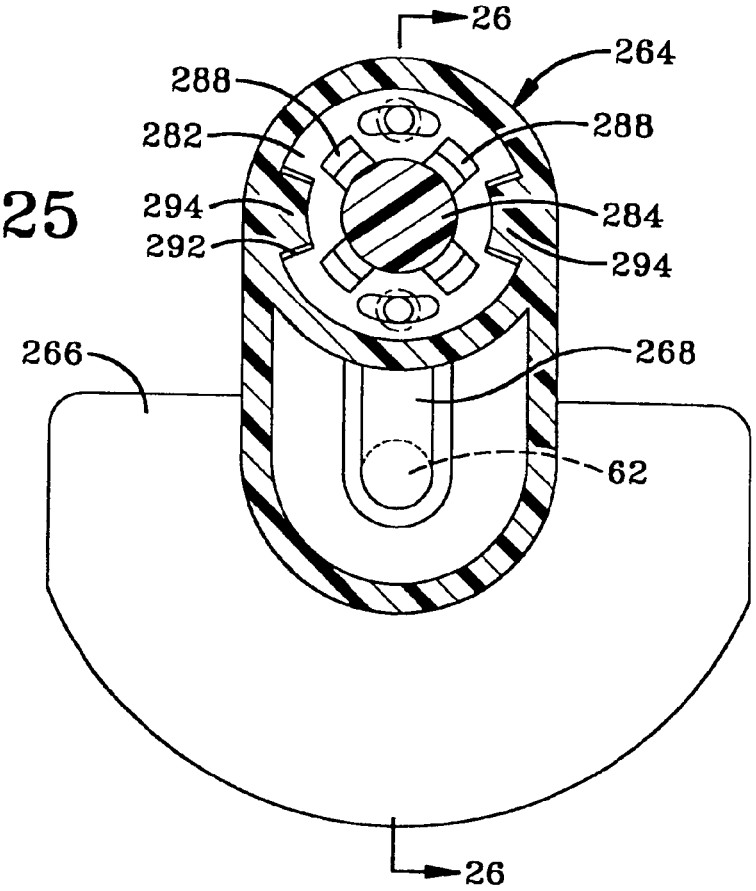
FIG. 25 is a section view taken along line 25—25 of FIG. 14 showing the end assembly in the locked position.
Figure 30:
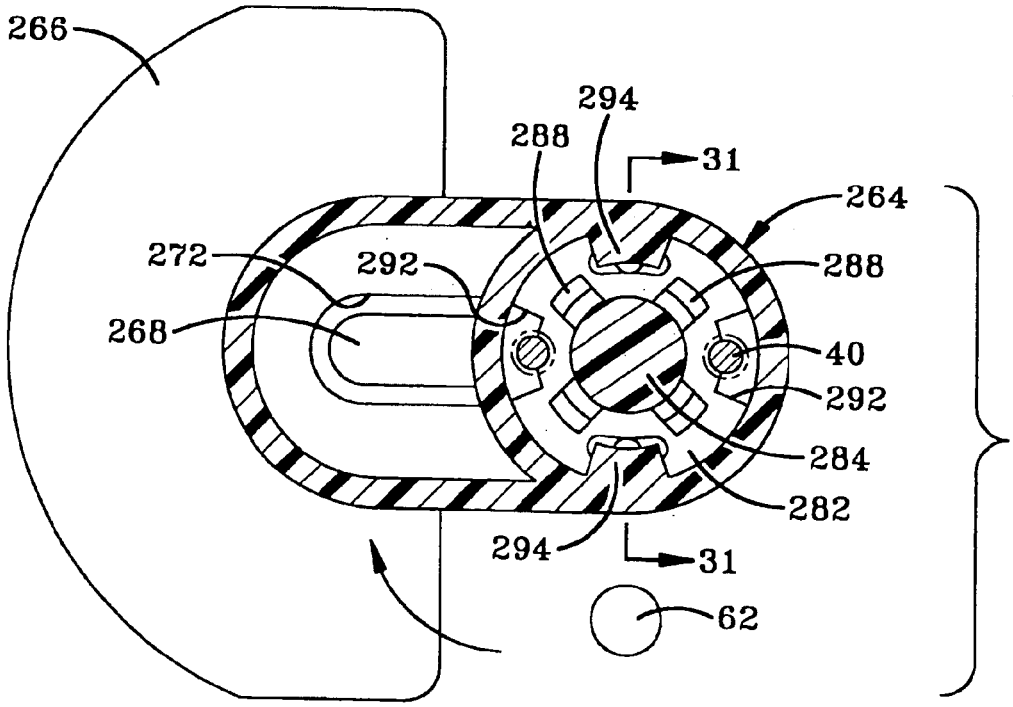
FIG. 30 is a view similar to FIG. 25 showing the end assembly being moved from the locked position toward the unlocked position.

The user of device 10 unlocks end assembly 64 by placing pins 40 of key 22 into openings 92 and depressing lock element 94 toward base assembly 20. When lock element 94 is depressed, protrusions 96 clear side wall 102 because they are moved out of depressions 100. This position is depicted in FIG. 11. In this position, spring 95 is compressed. Body 98 may then be rotated to the unlocked position depicted in FIGS. 12 and 13. In the unlocked position, each protrusion 96 rests on the outer surface of lock element 94 maintaining the compression of spring 95. Lock 90 remains in this position until body 98 is rotated back in the position depicted in FIG. 8 or 180 degrees from the position depicted in FIG. 8. In either position, rod 62 is exposed allowing the user of device 10 to easily load rod 62 with items 14 as depicted in FIG. 12.

The second embodiment of the security device of the invention is indicated generally by the numeral 200 in FIGS. 14 through 33. Device 200 generally functions in the same manner as device 10 described above. Device 200 thus allows multiple items of merchandise 14 to be carried by rod 62 in a manner that allows items 14 to be individually removed. Device 200 includes some of the same elements as device 10 and the same reference numbers are used to refer to these elements. In this embodiment, rods 60 and 62 may be integrally formed by bending a single length of metal rod.

Device 200 includes a locking base assembly 220 that selectively secures device 200 to board 12 in a manner that prevents device 200 from being removed from board 12 without the use of a specific key 22. Base assembly 220 includes an inner base 224 and an outer base 226. Outer base 226 slides over inner base 224 and locks inner base 224 in place against board 12. Inner base 224 has a main body with a pair of opposed flanges 230 projecting out from either side of the main body. Outer base 226 includes a pair of slots that receive flanges 230 when outer base 226 is slid over inner base 224.

A lock lockingly connects base 226 to base 224 when base 226 is slid all the way over base 224. Any of a variety of locks will function with base assembly 220. In this embodiment, a pair of protruding lock members 234 extend outwardly from the main body adjacent one flange 230 such that they catch and lock against ledges 236 formed in outer base 226. Each lock member 234 is resiliently cantilevered so that it may be depressed with a key. A set of key holes 238 is disposed in outer base 226 in a position where they align with lock member 234 when base 226 is locked in position on inner base 224. Lock 232 is unlocked when the pins 40 of key 22 are pushed through openings 238 and depressed lock member 234 down off of ledge 236. Once lock member 234 is depressed, outer base 226 may be slid off of inner base 224 so that inner base 224 may be removed from board 12. Outer base 226 extends substantially above rod 60 and provides a substantially large surface in contact with board 12. The size of outer base 226 helps to prevent a shoplifter from twisting device 200 off of board 12. In this embodiment of the invention, rod 60 extends outwardly from the center of base assembly 220.

Rods 60 and 62 project outwardly from base assembly 220 in a manner similar to that described above. Rods 60 and 62 function substantially the same as described above with lower rod 62 including an outer end over which items of merchandise 14 are removed. An end assembly 264 is positioned adjacent the outer end of rod 62 to prevent a shoplifter from rapidly removing all of the items of merchandise from rod 62. End assembly 264 forces the user of device 200 to remove items 14 one by one or at least in twos or threes. A flange 266 extends outwardly from the bottom portion of end assembly 264. Flange 266 is configured to remain adjacent the end of rod 62 if a shoplifter forces end assembly 264 upwardly or laterally with respect to rod 62 by bending rod 60 or by bending both rods 60 and 62 away from each other. The radius of flange 266 is configured to be large enough to be adjacent the end of rod 62 when a person pushes end assembly 264 as far as the flexibility of rods 60 and 62 will allow. Flange 266 thus provides a security function to device 200.

Figure 26:
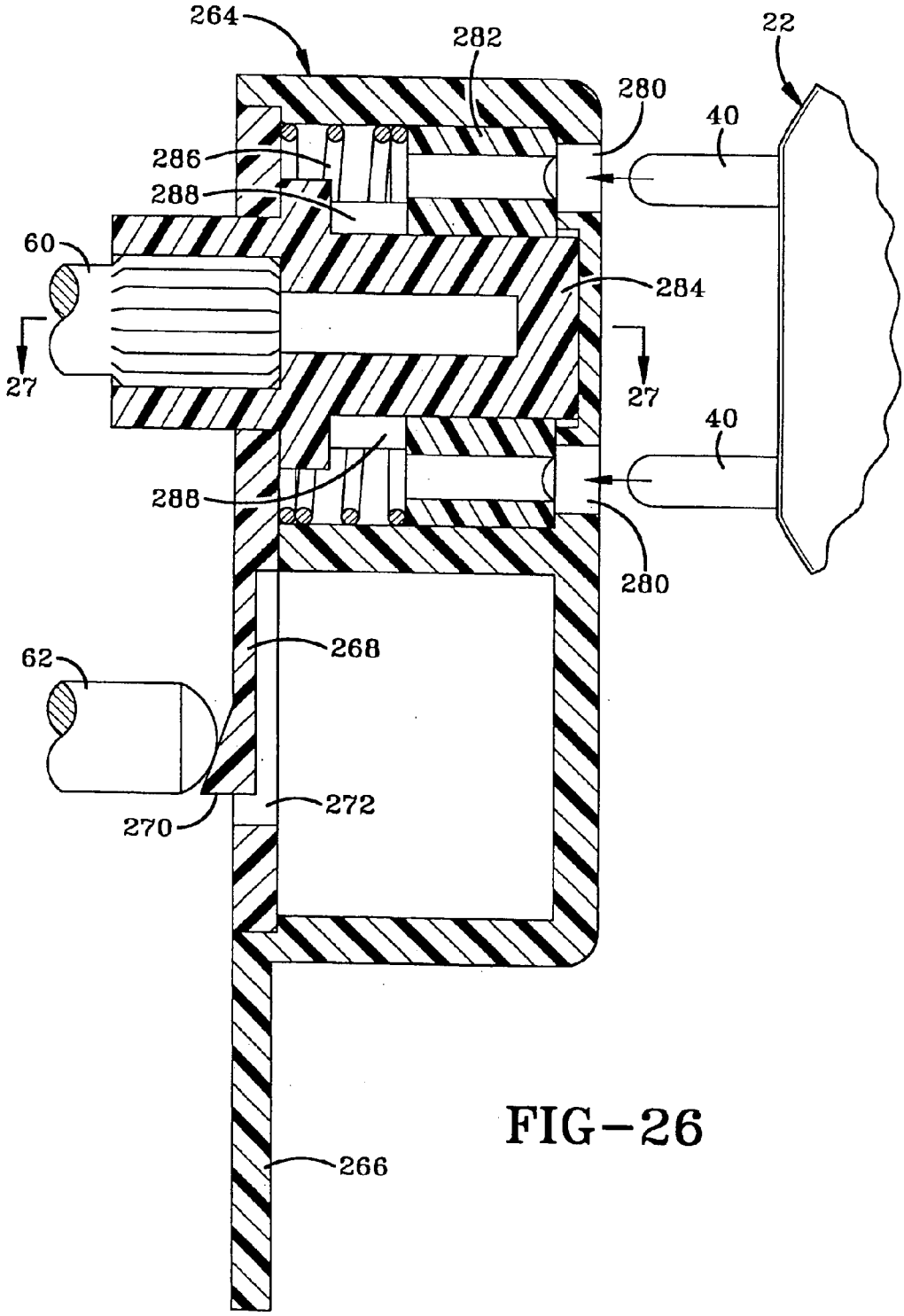
FIG. 26 is a section view taken along line 26—26 of FIG. 25.
Figure 27:
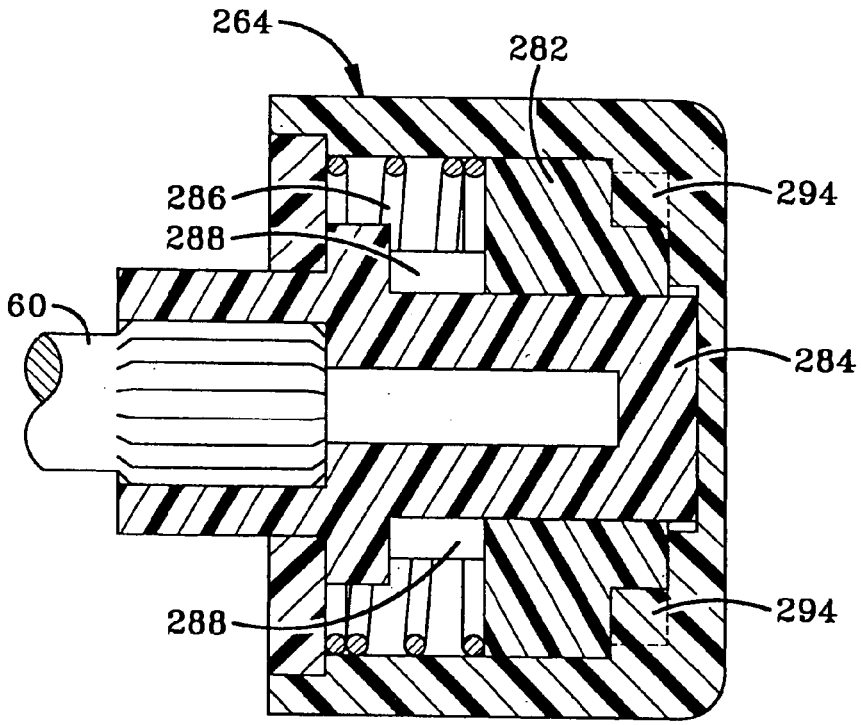
FIG. 27 is a section view taken along line 27—27 of FIG. 26.

In the second embodiment, end assembly 264 includes a cantilevered spring arm 268 that is positioned closely adjacent the end of rod 62 to prevent multiple items of merchandise 14 from being rapidly removed from rod 62. Arm 268 may include a protruding member 270 that contacts the end of rod 62 as depicted in FIG. 26. In this embodiment, end assembly 264 simply defines a space 272 behind arm 268 to allow arm 268 to flex away from rod 62 when items of merchandise 14 are pulled over the end of rod 62.

End assembly 264 also includes a lock mechanism that selectively locks end assembly 264 in the locked position depicted in FIG. 26. When the user unlocks the lock mechanism with key 22, the user may rotate end assembly upwardly to the unlocked position (FIGS. 30 and 32) to allow the user unfettered access to rod 62 (FIG. 32) to quickly load or unload merchandise from rod 62. Both mechanical and magnetically actuated lock mechanisms may be used with end assembly 264. The mechanically actuated lock mechanism depicted in FIGS. 25–32 is provided as another exemplary embodiment for the lock mechanism.

End assembly 264 includes a housing that defines pair of key openings 280 that receive pins 40 of key 22. Openings 280 are aligned with a biased lock element 282 that is slidably disposed on a base lock element 284. Biased lock element 282 is biased toward openings 280 by an appropriate biasing element 286 such as a coil spring. Other types of biasing elements may be used with the lock mechanism.

Base lock element 284 includes ribs 288 that prevent lock element 282 from rotating with respect to base lock element 284. Base lock element 284 is fixed on rod 60. Element 284 includes four equally-spaced ribs 288 that extend from a substantially cylindrical base.

Figure 32:
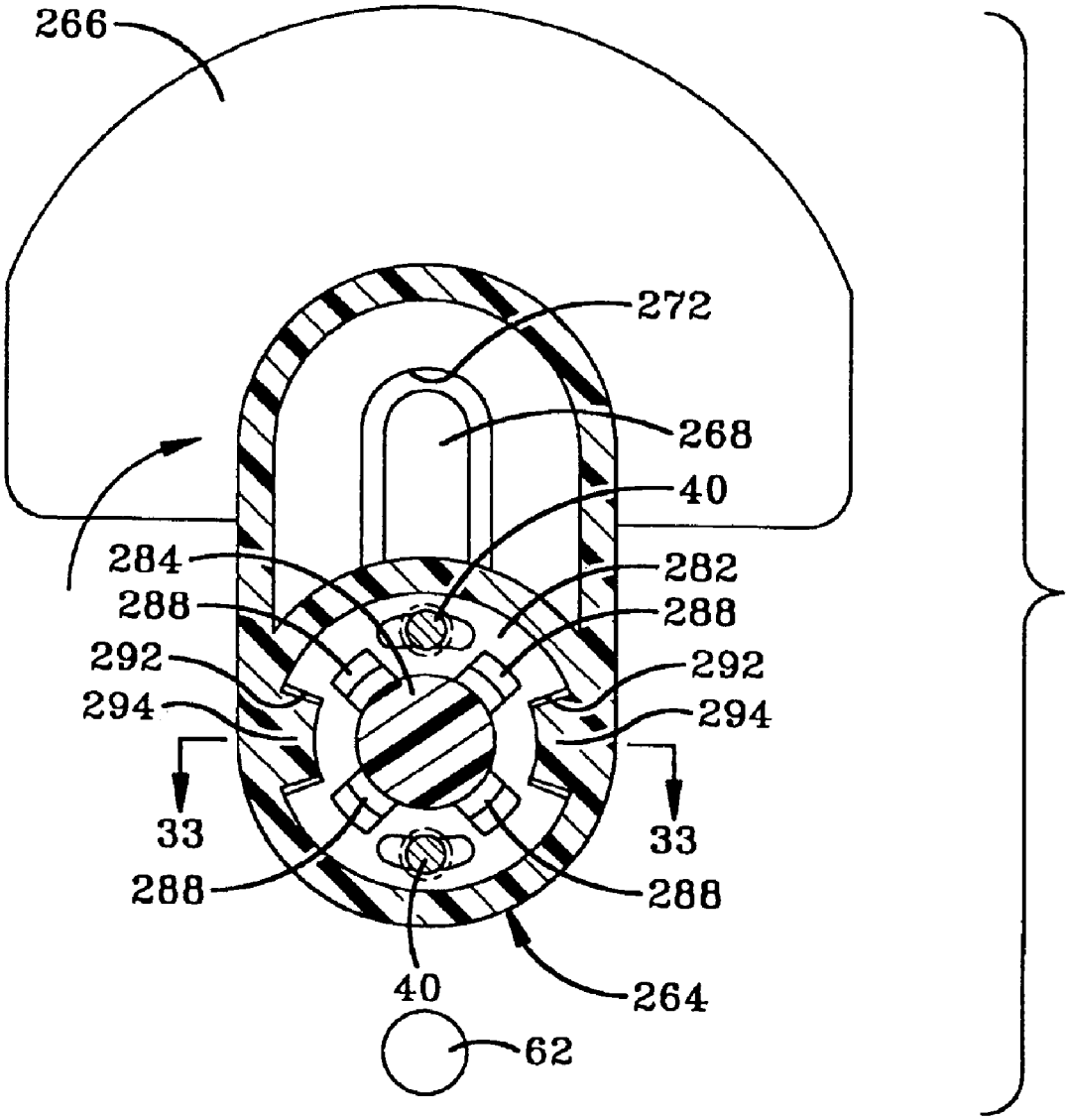
FIG. 32 is a view similar to FIG. 30 showing the end assembly moved 180 degrees to the unlocked position.

The face of biased lock element 282 disposed toward key openings 280 defines a pair of notches 292 that receive locking protrusions 294 when end assembly 264 is in the locked position. Locking protrusions 294 are connected to the housing of end assembly 264. When biased lock element 282 is in the locked position, protrusions 294 are received in notches 292 and the housing cannot rotate with respect to biased lock element 282—and thus cannot rotate with respect to rod 60. Key 22 pushes biased lock element 282 to the unlocked position wherein protrusions 294 are released from notches 292. In this position, the housing of end assembly may rotate with respect to biased lock element 282—and thus with respect to rod 60. If the user rotates the housing of end assembly 264 180 degrees, notches 292 are forced back over protrusions 294 and end assembly 264 is held in the unlocked position as shown in FIG. 32.

Figure 29:
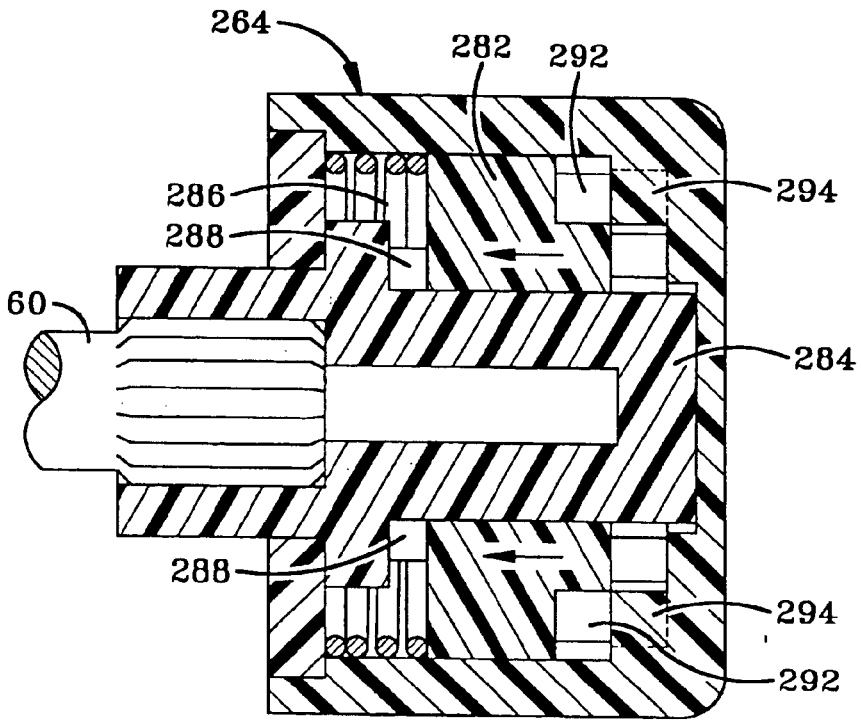
FIG. 29 is a section view taken along line 29—29 of FIG. 28.
Figure 28:
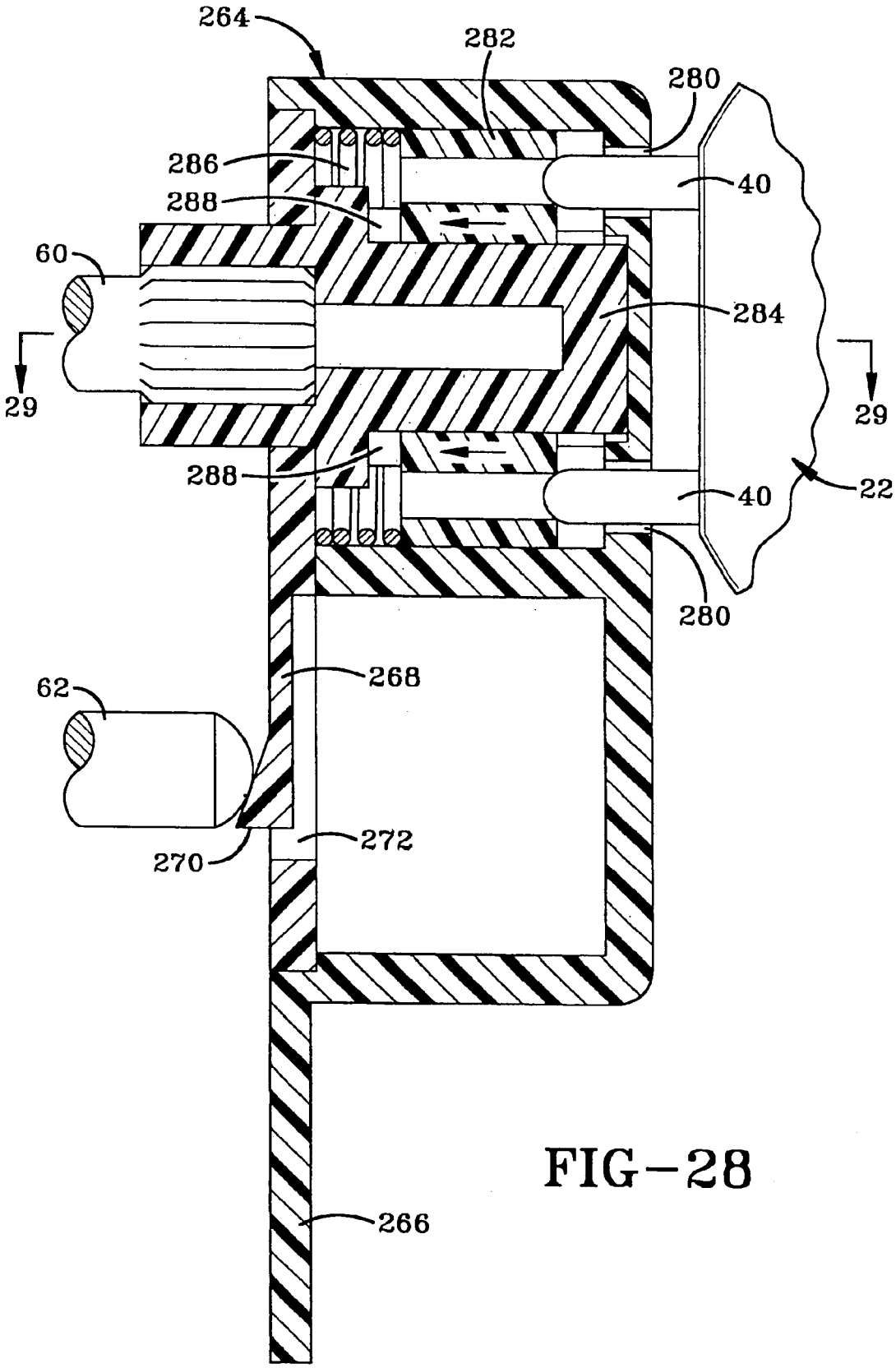
FIG. 28 is a section view similar to FIG. 25 showing the key moving the lock to the unlocked position.
Figure 31:
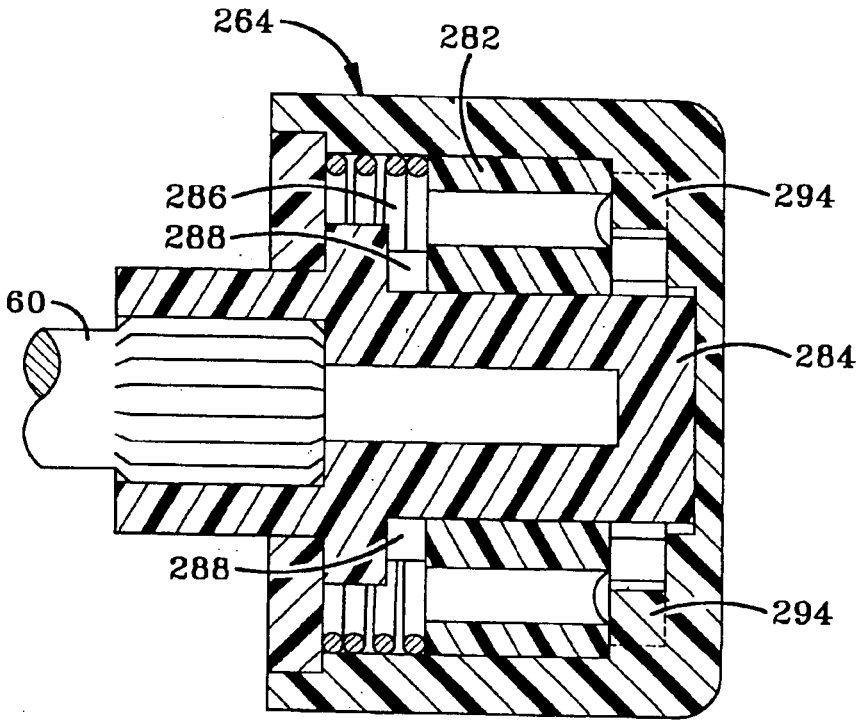
FIG. 31 is a section view taken along line 31—31 of FIG. 30.
Figure 33:
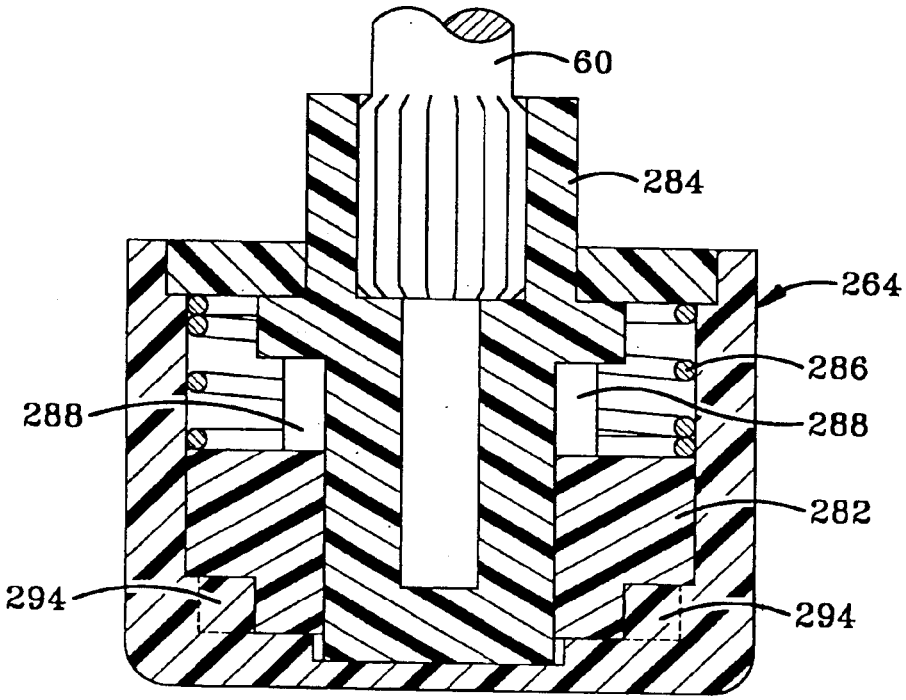
FIG. 33 is a section view taken along line 33—33 of FIG. 32.

The user of device 200 may thus load items 14 on rod 62 by inserting key 22 into openings 280 such that pins 40 move biased lock element 282 from the locked position (FIGS. 26 and 27) to the unlocked position (FIGS. 28 and 29). The user may then rotate end assembly from the locked position (FIGS. 26 and 27) to an unlocked position (FIGS. 32 and 33). The user may then quickly load items 14 on rod 62. After rod 62 is loaded, the user rotates end assembly 264 back to the locked position. In this position, multiple items 14 cannot be rapidly pulled from rod 62 because end assembly 264 is disposed adjacent the end of rod 62. The position and function of end assembly 264 frustrates shoplifters while allowing a legitimate consumer to remove items 14 one by one.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A display structure and security device for displaying items of merchandise; the combination comprising:

a display structure having an outer surface;

a security device removably mountable to the display structure;

the security device having a base and a first rod;

the first rod extending outwardly from the outer surface of the display structure when the security device is mounted to the display structure;

the base having locked and unlocked positions; the unlocked position of the base allowing the security device to be removed from the display structure;

a lock carried by the base; the lock locking the base in the locked position in abutment against the outer surface of the display structure;

the base cooperating with the outer surface of the display structure and the first rod to prevent the security device from being removed from the display structure when the base is in the locked position in abutment against the display structure; and a key configured to unlock the lock to allow the base to move from the locked position to the unlocked position.

2. The combination of claim 1, wherein the first rod is adapted to carry the items of merchandise; and the first rod having an outer end over which the items of merchandise are able to be removed from the security device.

3. The combination of claim 2, wherein the lock is configured to allow the items of merchandise to be removed when the lock is locking the base in the locked position.

4. The combination of claim 3, further comprising a second rod disposed adjacent the first rod; the second rod having an outer end.

5. The combination of claim 4, further comprising an end assembly carried by the outer end of the second rod; the end assembly adapted to prevent the rapid removal of the items of merchandise from the first rod.

6. The combination of claim 5, wherein the end assembly includes a biased member that abuts the outer end of the first rod.

7. The combination of claim 6, wherein the end assembly is a cup that surrounds a portion of the outer end of the first rod.

8. The combination of claim 1, wherein the lock includes a biased lock element that is movable between locked and unlocked positions.

9. The combination of claim 1, wherein the base member slides from the locked position to the unlocked position.

10. The combination of claim 9, wherein the first rod has a longitudinal axis and the base sliding in a direction substantially perpendicular to the longitudinal axis of the first rod.

11. A display structure and security device for displaying items of merchandise; the combination comprising:

a display structure having an outer surface;

a security device removably mountable to the display structure;

the security device having a base and a first rod;

the first rod extending outwardly from the outer surface of the display structure when the security device is mounted to the display structure;

the first rod being adapted to carry the items of merchandise;

the first rod having an outer end over which the items of merchandise are able to be removed from the security device;

an end assembly disposed adjacent the outer end of the first rod; the end assembly adapted to prevent the rapid removal of the items of merchandise from the first rod;

the base movable between locked and unlocked positions; the unlocked position of the base allowing the security device to be removed from the display structure;

a lock carried by the base; the lock locking the base in the locked position in abutment against the outer surface of the display structure;

the lock being configured to allow the items of merchandise to be removed when the lock is locking the base in the locked position;

the base cooperating with the outer surface of the display structure and the first rod to prevent the security device from being removed from the display structure when the base is in the locked position; and a key configured to unlock the lock to allow the base to move from the locked position to the unlocked position.

12. The combination of claim 11, wherein the end assembly includes a second lock that locks the end assembly in a position adjacent the outer end of the first rod.

13. The combination of claim 12, wherein the second lock of the end assembly may be unlocked with the key used to unlock the lock carried by the base.

14. A display structure and a security device for displaying items of merchandise; the combination comprising:

a display structure having an outer surface;

a security device mountable to the display structure;

the security device having a base and a first rod;

the first rod extending outwardly from the outer surface of the display structure when the security device is mounted to the display structure;

the first rod being adapted to carry the items of merchandise;

the first rod having an outer end over which the items of merchandise are able to be removed from the security device;

the base having locked and unlocked positions; the unlocked position of the base allowing the security device to be removed from the display structure;

a lock locking the base in the locked position in abutment against the outer surface of the display structure;

the lock being configured to allow the items of merchandise to be removed when the lock is locking the base in the locked position in abutment against the display structure; and the base cooperating with the outer surface of the display structure and the first rod to prevent the security device from being removed from the display structure when the base is in the locked position.

15. The combination of claim 14, wherein the lock includes a biased lock element that is movable between locked and unlocked positions.

16. The combination of claim 14, wherein the base member slides from the locked position to the unlocked position.

17. The combination of claim 14, wherein the lock is carried by the base.

* * * * *